US009829851B2

(12) United States Patent
Okura

(10) Patent No.: US 9,829,851 B2
(45) Date of Patent: Nov. 28, 2017

(54) CLEANING DEVICE AND IMAGE FORMING APPARATUS INCLUDING THE SAME

(71) Applicant: KYOCERA Document Solutions Inc., Osaka (JP)

(72) Inventor: Tomohisa Okura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/476,233

(22) Filed: Mar. 31, 2017

(65) Prior Publication Data

US 2017/0293249 A1 Oct. 12, 2017

(30) Foreign Application Priority Data

Apr. 6, 2016 (JP) ..... 2016-076499

(51) Int. Cl.
*G03G 21/00* (2006.01)
*G03G 21/10* (2006.01)

(52) U.S. Cl.
CPC ..... *G03G 21/0011* (2013.01); *G03G 21/0035* (2013.01); *G03G 21/105* (2013.01)

(58) Field of Classification Search
CPC ..... G03G 21/0011; G03G 21/0035; G03G 21/105
See application file for complete search history.

(56) References Cited

U.S. PATENT DOCUMENTS 6,832,067 B2 * 12/2004 Kubo ..... G03G 21/105 399/350
8,862,043 B2 * 10/2014 Ikebata ..... G03G 21/105 399/256
9,176,455 B2 * 11/2015 Fujii ..... G03G 21/0029

FOREIGN PATENT DOCUMENTS

JP 2012-203331 A 10/2012

* cited by examiner

*Primary Examiner* — Gregory H Curran
(74) *Attorney, Agent, or Firm* — Stein IP, LLC

(57) ABSTRACT

A cleaning device of the disclosure includes a housing, a cleaning member, a cleaning blade, a seal member, a discharge screw, and a first film member as well as a second film member. In the housing, a waste toner containing part is formed. The discharge screw is placed in the waste toner containing part. The first film member and the second film member are reciprocatively moved in a radial direction of the rotating shaft. The first film member is so positioned as to be inclined constantly downward as it becomes farther and farther from the seal member. A second end portion of the second film member is placed between the discharge screw and the seal member.

8 Claims, 3 Drawing Sheets

CLEANING DEVICE AND IMAGE FORMING APPARATUS INCLUDING THE SAME

INCORPORATION BY REFERENCE

This application is based upon and claims the benefit of priority from the corresponding Japanese Patent Application No. 2016-076499 filed on Apr. 6, 2016, the entire contents of which are incorporated herein by reference.

BACKGROUND

The present disclosure relates to a cleaning device and an image forming apparatus including the cleaning device. In particular, the disclosure relates to a cleaning device including a cleaning member for removing residual toner on a surface of an image carrier, and a discharge screw for discharging toner scraped off from a surface of the cleaning member to outside, the disclosure further relating to an image forming apparatus equipped with the cleaning device.

In image forming apparatuses using electrophotographic process such as copiers, printers and facsimiles, powdery developers are principally employed and it is common practice to take the steps of visualizing an electrostatic latent image formed on a photosensitive drum or other image carrier with use of a developing unit, transferring the visible image (toner image) onto a recording medium, and thereafter subjecting the transferred image to a fixing process. Toner remaining on the surface of the image carrier is removed by the cleaning device, followed by formation of a new toner image.

A cleaning device of one type among currently available ones includes: a cleaning member composed of a fur brush for removing toner from a surface of an image carrier and a collecting roller for collecting toner from the fur brush; a cleaning blade for scraping off toner from a surface of the collecting roller; a discharge screw for discharging toner scraped off from the surface of the collecting roller to outside; and a seal member for partitioning a housing interior into a collecting-roller side and a discharge-screw side.

SUMMARY

A cleaning device according to one aspect of the disclosure includes a housing, a roller-like cleaning member, a cleaning blade, a sheet-like seal member, a discharge screw, and a first film member as well as a second film member. In the housing, an opening facing an image carrier, and a waste toner containing part for storing toner scraped off from a surface of the image carrier, are formed. The cleaning member is placed in proximity to the opening of the housing and serves for removing residual toner on the surface of the image carrier. The cleaning blade scrapes off waste toner on a surface of the cleaning member. The seal member is placed in contact with the cleaning member so as to extend in a longitudinal direction of the cleaning member and serves for suppressing backflow of waste toner from the waste toner containing part toward the opening side. The discharge screw is placed in the waste toner containing part and has a rotating shaft and a screw blade to convey waste toner in a radial direction of the rotating shaft and discharge the waste toner to outside of the waste toner containing part. The first film member and the second film member are insertable between portions of the screw blade and are, along with rotation of the discharge screw, reciprocatively moved in the radial direction of the rotating shaft between an outermost circumferential surface of the screw blade and an outer circumferential surface of the rotating shaft. The first film member is so positioned as to be inclined constantly downward as it becomes farther and farther from the seal member. A first end portion of the first film member on one side closer to the seal member is placed on one side of a rotational center of the discharge screw closer to the seal member and is reciprocatively moved in the radial direction of the rotating shaft. The second film member is so positioned as to be inclined constantly upward as it becomes farther and farther from the seal member, and a second end portion of the second film member on one side closer to the seal member is placed between the discharge screw and the seal member and is reciprocatively moved in the radial direction of the rotating shaft.

Still further objects of the disclosure as well as concrete advantages obtained by the disclosure will become more apparent from an embodiment thereof described hereinbelow.

DETAILED DESCRIPTION

Hereinbelow, an embodiment of the disclosure will be described with reference to the accompanying drawings.

Figure 1:
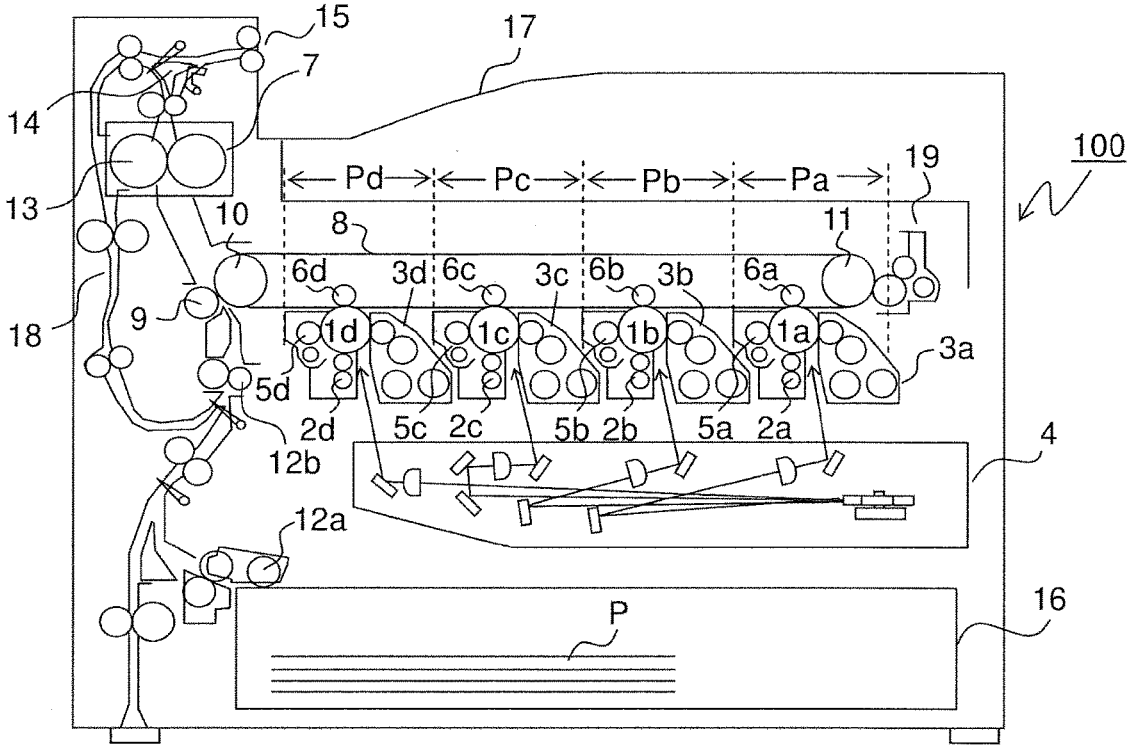
FIG. 1 is a schematic view showing a structure of an image forming apparatus including a belt cleaning unit (cleaning device) according to one embodiment of the disclosure.
Figure 2:
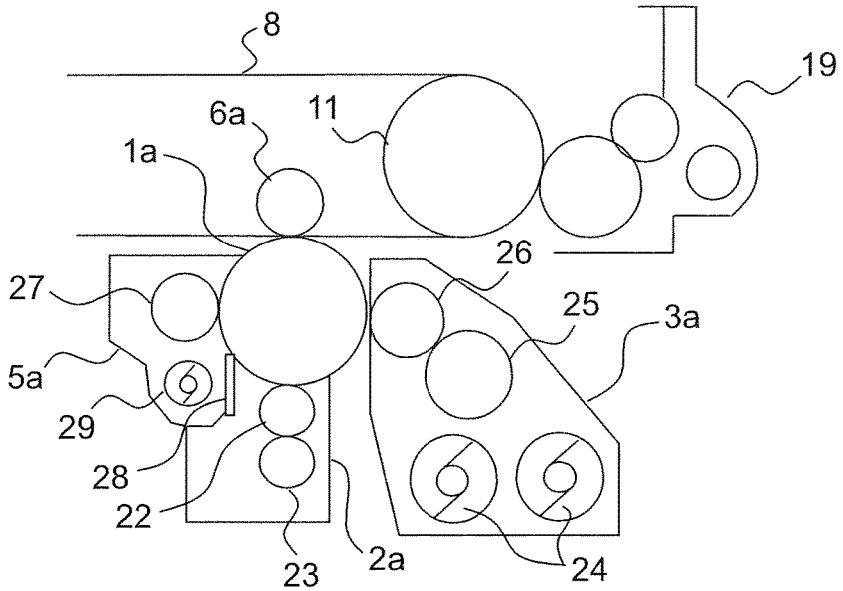
FIG. 2 is an enlarged view of a vicinity of an image forming part Pa in FIG. 1.
Figure 3:
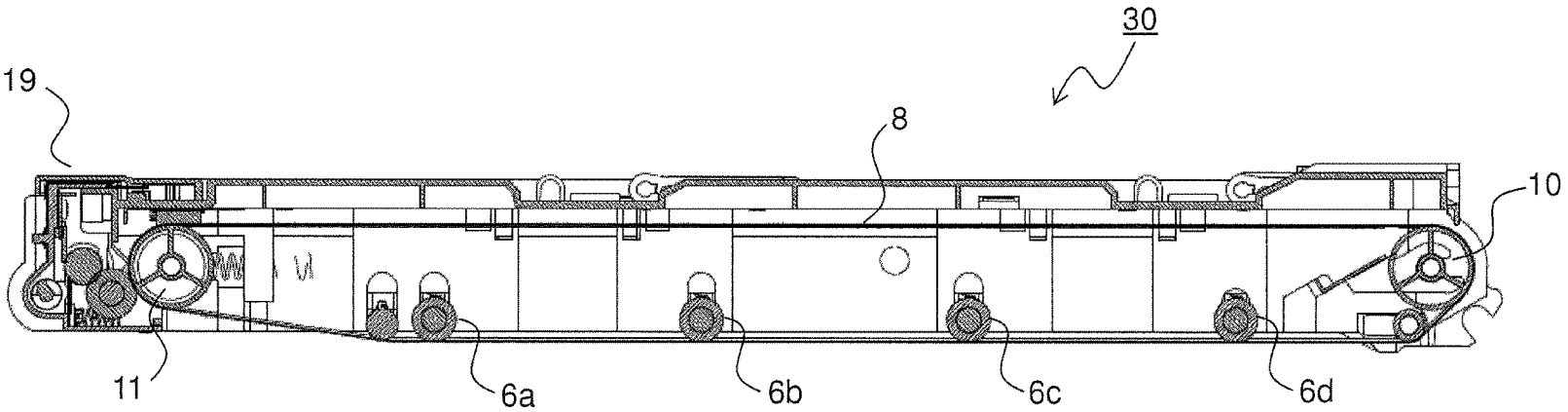
FIG. 3 is a transverse sectional view of an intermediate transfer unit to be mounted on the image forming apparatus.

FIG. 1 is a schematic view showing a structure of an image forming apparatus 100 including a belt cleaning unit 19 serving as a cleaning device according to one embodiment of the disclosure. FIG. 2 is an enlarged view of a vicinity of an image forming part Pa in FIG. 1. FIG. 3 is a transverse sectional view of an intermediate transfer unit 30 to be mounted on the image forming apparatus 100. FIG. 3 shows a state of the intermediate transfer unit 30 as viewed from its back side of FIG. 1.

The image forming apparatus 100 of FIG. 1 is constituted as follows. In a body of the image forming apparatus 100, four image forming parts Pa, Pb, Pc and Pd are disposed in this order from an upstream side (right side in FIG. 1) of the conveyance direction. These image forming parts Pa to Pd are provided in correspondence to images of different four colors (cyan, magenta, yellow and black), respectively. The image forming parts Pa to Pd form images of cyan, magenta, yellow and black, respectively and successively, each through charging, exposure, development and transfer processes.

In these image forming parts Pa to Pd, photosensitive drums 1*a*, 1*b*, 1*c* and 1*d*, respectively, for carrying visible images (toner images) of their respective colors are set up. Further, an intermediate transfer belt (image carrier) 8 which is rotated clockwise as in FIG. 1 by drive means (not shown) is provided in adjacency to the image forming parts Pa to Pd. Toner images formed on the photosensitive drums 1*a* to 1*d*, respectively, are transferred onto the intermediate transfer belt 8 moving under contact with the photosensitive drums 1*a* to 1*d*, successively, and thereafter at a secondary transfer roller 9, transferred all at once onto a transfer sheet (paper sheet) P as an example of a recording medium. Further, the toner images are fixed on the transfer sheet P at a fixing part 7, and then discharged out of the image forming apparatus 100 body. While the photosensitive drums 1*a* to 1*d* are being rotated counterclockwise as seen in FIG. 1, image formation process for each of the photosensitive drums 1*a* to 1*d* is executed.

Transfer sheets P onto which toner images are to be transferred are set in a sheet cassette 16 placed in lower part of the body of the image forming apparatus 100. A transfer sheet P is conveyed via a sheet feed roller 12*a* and a registration roller pair 12*b* to the secondary transfer roller 9. The intermediate transfer belt 8 is provided as a dielectric resin sheet, and mostly a seamless belt is used therefor.

Next, the image forming parts Pa to Pd will be described. Around and below the photosensitive drums 1*a* to 1*d* set rotatable, there are provided: chargers 2*a*, 2*b*, 2*c* and 2*d* for electrically charging the photosensitive drums 1*a* to 1*d*, respectively; an exposure unit 4 for exposing the photosensitive drums 1*a* to 1*d* to image-information light; developing units 3*a*, 3*b*, 3*c* and 3*d* for forming toner images on the photosensitive drums 1*a* to 1*d*, respectively; and cleaning units 5*a*, 5*b*, 5*c* and 5*d* for removing developer (toner) remaining on the photosensitive drums 1*a* to 1*d*, respectively.

A detailed description about the image forming part Pa will be given below with reference to FIG. 2. The other image forming parts Pb to Pd as well are basically similar in constitution thereto and so their description is omitted. Around the photosensitive drum 1*a*, as shown in FIG. 2, the charger 2*a*, the developing unit 3*a* and the cleaning unit 5*a* are disposed along a drum rotation direction (counterclockwise direction in FIG. 1), and a primary transfer roller 6*a* is placed with the intermediate transfer belt 8 interposed against the photosensitive drum 1*a*. Furthermore, a belt cleaning unit 19 is placed so as to face a tension roller 11 with the intermediate transfer belt 8 interposed against the photosensitive drum 1*a* on the upstream side of the intermediate transfer belt 8 in its rotational direction.

The charger 2*a* has a charging roller 22 for applying a charging bias onto a surface of the photosensitive drum 1*a* under contact therewith, and a charge cleaning roller 23 for cleaning the charging roller 22. The developing unit 3*a* has two stirring conveyance screws 24, a magnetic roller 25 and a developing roller 26, and applies to the developing roller 26 a developing bias of the same polarity (positive polarity) as toner to make toner flown to the drum surface.

The cleaning unit 5*a* has a sliding roller 27, a drum cleaning blade 28 and a collecting screw 29. The sliding roller 27, set in pressure contact with the photosensitive drum 1*a* at a specified pressure, is driven by an unshown drive means into rotation in a constant direction at a contact surface with the photosensitive drum 1*a*. The sliding roller 27 is controlled so as to be faster (1.2 times faster in this case) in circumferential speed than the photosensitive drum 1*a*.

On the downstream side of the surface of the photosensitive drum 1*a*, downstream of its contact surface with the sliding roller 27, in the rotational direction of the photosensitive drum 1*a*, the drum cleaning blade 28 is fixed so as to be in contact with the photosensitive drum 1*a*.

Residual toner removed from the surface of the photosensitive drum 1*a* by the sliding roller 27 and the drum cleaning blade 28 is discharged to outside of the cleaning unit 5*a* along with rotation of the collecting screw 29, being conveyed to and stored in a toner collecting container (not shown). Used as the toner in this disclosure are those in which silica, titanium oxide, strontium titanate, alumina or the like is buried as a polishing agent in toner particle surfaces and held partly protruded from the surfaces, or those in which the polishing agent is electrostatically deposited on the toner surfaces.

As shown in FIG. 3, the intermediate transfer unit 30 includes the intermediate transfer belt 8 stretched between and on a downstream-side driving roller 10 and an upstream-side tension roller 11, and primary transfer rollers 6*a* to 6*d* set in contact with the photosensitive drums 1*a* to 1*d*, respectively, via the intermediate transfer belt 8. Also, the belt cleaning unit 19 for removing toner remaining on the intermediate transfer belt 8 surface is placed at a position facing the tension roller 11. A detailed construction of the belt cleaning unit 19 will be described later.

Next, an image formation procedure in the image forming apparatus 100 will be described. When an image formation start is inputted by a user, surfaces of the photosensitive drums 1*a* to 1*d* are, first, electrically charged uniformly by the chargers 2*a* to 2*d*, respectively. Then, the surfaces of the photosensitive drums 1*a* to 1*d* are exposed to photoirradiation by the exposure unit 4, by which electrostatic latent images corresponding to image signals are formed on the photosensitive drums 1*a* to 1*d*, respectively. In the developing units 3*a* to 3*d*, toners of individual colors of cyan, magenta, yellow and black, respectively, are filled to specified quantity by supply devices (not shown). The toners are fed onto and electrostatically deposited on the photosensitive drums 1*a* to 1*d* by the developing units 3*a* to 3*d*, respectively. Thus, toner images corresponding to the electrostatic latent images formed by the exposure from the exposure unit 4 are formed.

Then, by the primary transfer rollers 6*a* to 6*d*, electric fields are applied at specified transfer voltages to between the primary transfer rollers 6*a* to 6*d* and the photosensitive drums 1*a* to 1*d*, respectively. As a result, the toner images of cyan, magenta, yellow and black on the photosensitive drums 1*a* to 1*d*, respectively, are primarily transferred onto the intermediate transfer belt 8. These four-color images are formed in a specified positional relationship which is predetermined for specified full-color image formation. Thereafter, in preparation for subsequent formation of new electrostatic latent images, toner remaining on the surfaces of the photosensitive drums 1*a* to 1*d* is removed by the cleaning units 5*a* to 5*d*.

When the intermediate transfer belt 8 has started to be rotated clockwise along with rotation of the driving roller 10 effected by a drive motor (not shown), the transfer sheet P is conveyed from the registration roller pair 12*b* at a specified timing to the secondary transfer roller 9 provided in adjacency to the intermediate transfer belt 8, where a full-color image is transferred to the transfer sheet P. The transfer sheet P with the toner image transferred thereto is conveyed to the fixing part 7. Toner remaining on the surface of the intermediate transfer belt 8 is removed by the belt cleaning unit 19.

The transfer sheet P conveyed to the fixing part 7 is heated and pressurized by a fixing roller pair 13 so that the toner image is fixed on the surface of the transfer sheet P. Thus, a specified full-color image is formed. The transfer sheet P with the full-color image formed thereon is classified in conveyance direction by a branch part 14 branched into plural directions. For image formation only on one side of the transfer sheet P, the transfer sheet P is discharged, as it is, to a discharge tray 17 by a discharge roller 15.

For image formation on both sides of the transfer sheet P, on the other hand, the transfer sheet P having passed through the fixing part 7 is once partly protruded from the discharge roller 15 up to outside of the apparatus. Thereafter, the transfer sheet P is classified and directed to a sheet conveyance path 18 at the branch part 14 by reverse rotation of the discharge roller 15, so that the transfer sheet P is reconveyed to the secondary transfer roller 9 with the image-formed side inverted. Then, a next image formed on the intermediate transfer belt 8 is transferred onto the image-unformed side of the transfer sheet P by the secondary transfer roller 9. The transfer sheet P is conveyed to the fixing part 7, where the toner image is fixed, and thereafter the transfer sheet P is discharged to the discharge tray 17.

Next, the structure of the belt cleaning unit 19 will be described.

Figure 4:
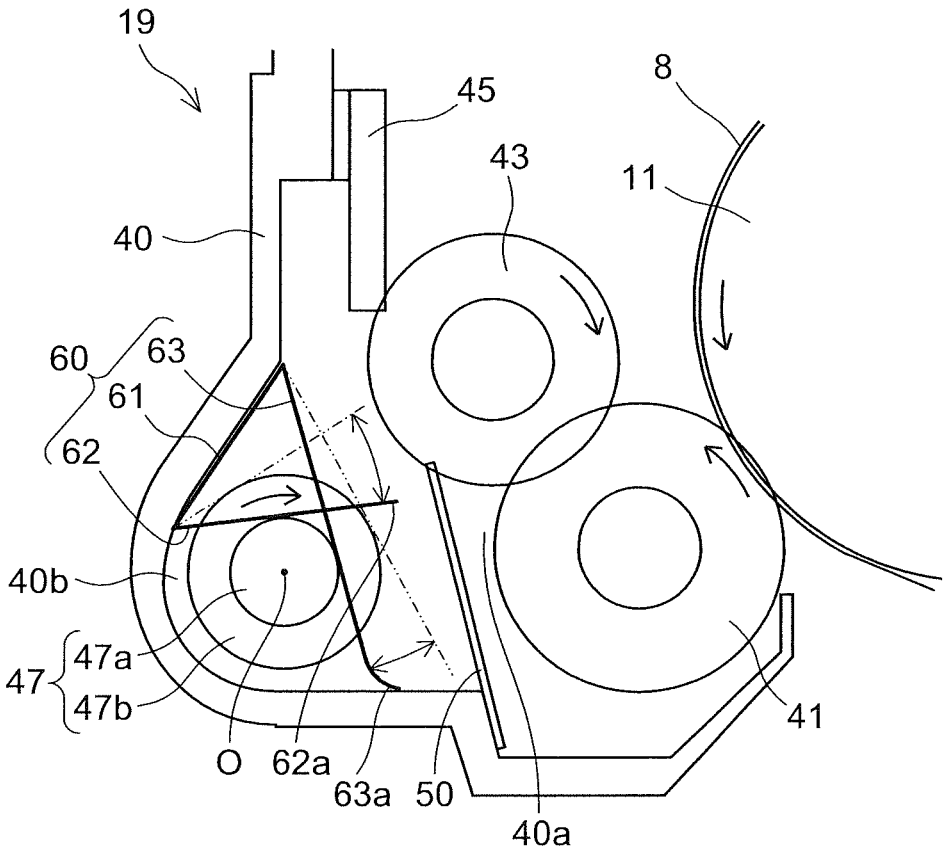
FIG. 4 is a transverse sectional view showing an internal structure of the belt cleaning unit.

As shown in FIG. 4, the belt cleaning unit 19 includes, in a housing 40, a fur brush (cleaning member) 41, a collecting roller (cleaning member) 43, a cleaning blade 45, and a discharge screw 47. At one end of the housing 40, a drive input gear train (not shown) for inputting driving force to the fur brush 41, the collecting roller 43 and the discharge screw 47 is placed. The fur brush 41 is so made up that a fiber of insulative resin such as acrylic resin or rayon with electroconductivity imparted thereto by carbon or the like is wound on a shaft made of SUS or the like. On one side of the housing 40 where an opening 40*a* is provided, the fur brush 41 is placed so as to face the tension roller 11 with the intermediate transfer belt 8 interposed therebetween. The fur brush 41 is rotated in a counter direction (counterclockwise direction in FIG. 4) relative to a moving direction of the intermediate transfer belt 8 to scrape off toner and paper dust or other foreign matters (hereinafter, referred to as toner and others) remaining on the intermediate transfer belt 8. The scraped-off toner and others adhere to the brush part of the fur brush 41.

The collecting roller 43 is formed of a shaft made of SUS or the like or a shaft having a resistive layer of alumite or the like on its surface. The collecting roller 43, while keeping in contact with the surface of the fur brush 41, is rotated in the counter direction (clockwise direction in FIG. 4) relative to the fur brush 41. Moreover, the collecting roller 43, to which a bias of a reverse polarity relative to the toner is applied, collects toner and others adhering to the fur brush 41. The cleaning blade 45, which is fixed to the housing 40, makes contact with the collecting roller 43 from the downstream side of the rotational direction of the collecting roller 43 (counter direction relative to the moving direction of the surface of the collecting roller 43) to scrape off the toner and others collected by the collecting roller 43, thereby cleaning the collecting roller 43. The discharge screw 47 is placed within a waste toner containing part 40*b* of the housing 40. The discharge screw 47 is composed of a rotating shaft 47*a* extending in a longitudinal direction of the collecting roller 43 (vertical direction relative to the drawing sheet of FIG. 4), and a screw blade 47*b* provided around the rotating shaft 47*a*. The discharge screw 47 is rotated in the clockwise direction in FIG. 4 to convey the toner and others scraped off from the collecting roller 43 by the cleaning blade 45 in the axial direction of the rotating shaft 47*a*, and discharge those toner and others outside the housing 40.

In the housing 40, a seal member 50 is placed so as to extend in the longitudinal direction of the collecting roller 43 under contact with the collecting roller 43 over its entire longitudinal length. The seal member 50 is a sheet-like member formed of, e.g., polyurethane or polyethylene terephthalate (PET). The seal member 50 is provided in order to suppress backflow of the toner and others, which have been scraped off by the cleaning blade 45, from the waste toner containing part 40*b* toward the collecting roller 43 side (opening 40*a* side), with an upper end portion of the seal member 50 in contact with the collecting roller 43 at a specified contact pressure.

In the waste toner containing part 40*b*, a one-sheet film member (first film member, second film member) 60 is provided for moving the toner and others, which have been scraped off by a contact portion (scraping-off portion) between the collecting roller 43 and the cleaning blade 45, toward the discharge screw 47 side (left side in FIG. 4).

Figure 5:
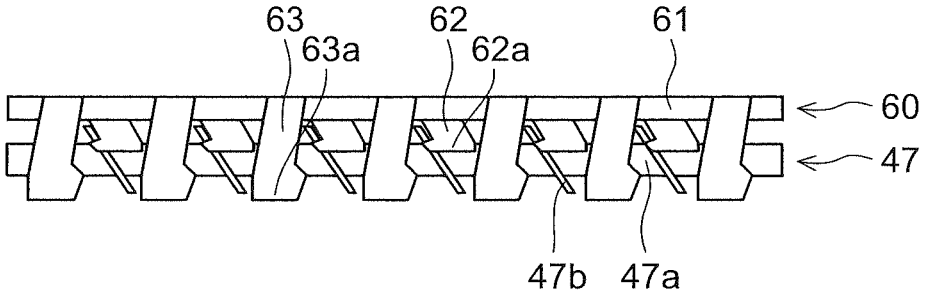
FIG. 5 is a view showing a structure of a film member and a discharge screw in the belt cleaning unit according to one embodiment of the disclosure as it is viewed from above.

As shown in FIGS. 4 and 5, the film member 60, which is formed of a film having flexibility (e.g., PET film), includes a base portion (first base portion, second base portion) 61 placed so as to extend in the axial direction of the rotating shaft 47*a*, a plurality of first protrusions 62 protruded from a lower-end edge portion of the base portion 61 toward directions crossing with the axial direction of the rotating shaft 47*a*, and a plurality of second protrusions 63 protruded from an upper-end edge portion of the base portion 61 toward directions crossing with the axial direction of the rotating shaft 47*a*.

The base portion 61 is bonded to the housing 40 with use of an adhesion layer (not shown) formed of a double-sided tape or the like.

The first protrusions 62 are in contact with the discharge screw 47 as they are bent at an acute angle against the base portion 61. The first protrusions 62 are placed on the upper side of the rotating shaft 47*a* of the discharge screw 47. Also, portions (fore end portions) of the first protrusions 62 on one side opposite to the base portion 61 side are formed so as to be swingable on fulcra given by their base portion 61-side portions (root portions).

The first protrusions 62 are formed so as to be insertable between neighboring ones of the screw blade 47*b* of the discharge screw 47, respectively. By rotation of the discharge screw 47, the first protrusions 62 are reciprocatively moved between an outermost circumferential surface of the screw blade 47*b* and the outer circumferential surface of the rotating shaft 47*a* in the radial direction of the rotating shaft 47*a*.

Furthermore, the first protrusions 62 are so positioned as to be inclined downward as they become farther and farther from the seal member 50 (nearer to the base portion 61) at all times whether the first protrusions 62 are swinging upward (being in contact with the outermost circumferential surface of the screw blade 47*b*) or swinging downward (being in contact with the outer circumferential surface of the rotating shaft 47*a*).

First end portions 62*a* of the first protrusions 62 on the seal member 50 side are placed on one side of a rotational center O of the discharge screw 47 closer to the seal member 50, preferably placed at a position on the seal member 50 side of the contact portion (scraping-off portion) between the collecting roller 43 and the cleaning blade 45. Also, the first end portions 62*a* are placed on the upper side of the upper end portion of the seal member 50 while the first protrusions 62 are in contact with at least the outermost circumferential surface of the screw blade 47*b* (at least swinging upward). While the first protrusions 62 are in contact with the outer circumferential surface of the rotating shaft 47*a*, the first end portions 62*a* are placed on the lower side of the upper end portion of the seal member 50 in FIG. 4, but may also be placed on the upper side of the upper end portion of the seal member 50.

The second protrusions 63, while bent at an acute angle relative to the base portion 61, come into contact with the discharge screw 47. The second protrusions 63 are placed on the upper side of the rotating shaft 47*a* of the discharge screw 47. Also, portions (fore end portions) of the second protrusions 63 on one side opposite to the base portion 61 side are formed so as to be swingable on fulcra given by their base portion 61-side portions (root portions).

The second protrusions 63 are formed so as to be insertable between portions of the screw blade 47*b* of the discharge screw 47, respectively. By rotation of the discharge screw 47, the second protrusions 63 are reciprocatively moved between the outermost circumferential surface of the screw blade 47*b* and the outer circumferential surface of the rotating shaft 47*a* in the radial direction of the rotating shaft 47*a*. In addition, the second protrusions 63 are given a tendency to be folded against the base portion 61 so as to keep normally in contact with the discharge screw 47.

Furthermore, the second protrusions 63 are so positioned as to be inclined upward as they become farther and farther from the seal member 50 (nearer to the base portion 61) at all times whether the second protrusions 63 are swinging upward (being in contact with the outermost circumferential surface of the screw blade 47*b*) or swinging downward (being in contact with the outer circumferential surface of the rotating shaft 47*a*).

Second end portions 63*a* of the second protrusions 63 on the seal member 50 side are placed between the discharge screw 47 and the seal member 50. Also, the second end portions 63*a* are placed in proximity to the seal member 50 while the second protrusions 63 are in contact with the outermost circumferential surface of the screw blade 47*b* (swinging upward). Further, the second end portions 63*a* are placed on the lower side of the rotational center O of the discharge screw 47, preferably placed so as to be contactable with a bottom face of the waste toner containing part 40*b*.

In this embodiment, as described above, the first protrusions 62 are so positioned as to be inclined constantly downward as they become farther and farther from the seal member 50, and the first end portions 62*a* of the first protrusions 62 are placed on one side of the rotational center O of the discharge screw 47 closer to the seal member 50 and moreover reciprocatively moved in the radial direction of the rotating shaft 47*a*. As a result of this, toner scraped off by the contact portion (scraping-off portion) between the collecting roller 43 and the cleaning blade 45 can be received by the first protrusions 62. Then, by the first protrusions 62 being reciprocatively moved in the radial direction of the rotating shaft 47*a*, the received toner can be moved toward the discharge screw 47 side (a direction of going farther from the seal member 50), so that deposition of toner between the discharge screw 47 and the seal member 50 can be suppressed. Therefore, since such deposition of toner as to lead to its contact with the collecting roller 43 can be suppressed, occurrence of image failures caused by conveyance of toner to the intermediate transfer belt 8 via the collecting roller 43 and the fur brush 41 can be suppressed.

The second protrusions 63 are so positioned as to be inclined constantly upward as they become farther and farther from the seal member 50, and the second end portions 63*a* of the second protrusions 63 are placed between the discharge screw 47 and the seal member 50 and moreover reciprocatively moved in the radial direction of the rotating shaft 47*a*. As a result of this, by the second protrusions 63 being reciprocatively moved in the radial direction of the rotating shaft 47*a*, toner deposited between the discharge screw 47 and the seal member 50 without being received by the first protrusions 62 can be loosened and scraped together toward the discharge screw 47 side. Therefore, since such deposition of toner as to lead to its contact with the collecting roller 43 between the discharge screw 47 and the seal member 50 can be further suppressed, occurrence of image failures caused by conveyance of toner to the intermediate transfer belt 8 via the collecting roller 43 and the fur brush 41 can be further suppressed.

The first protrusions 62 and the second protrusions 63 are insertable between portions of the screw blade 47*b*, respectively, and by rotation of the discharge screw 47, the first protrusions 62 and the second protrusions 63 are reciprocatively moved between the outermost circumferential surface of the screw blade 47*b* and the outer circumferential surface of the rotating shaft 47*a* in the radial direction of the rotating shaft 47*a*. As a result of this, there is no need for additionally providing a driving source for reciprocatively moving the first protrusions 62 and the second protrusions 63 in the radial direction of the rotating shaft 47*a*.

Also as described above, the first protrusions 62 are placed on the upper side of the rotating shaft 47*a*. By virtue of this, toner scraped off by the contact portion (scraping-off portion) between the collecting roller 43 and the cleaning blade 45 can be received by the first protrusions 62 ahead of the discharge screw 47. Thus, the toner can be prevented from being moved toward the seal member 50 side by the discharge screw 47. Accordingly, since the toner can be moved efficiently toward the depth side of the waste toner containing part 40*b* (in a direction of going farther from the seal member 50), deposition of the toner between the discharge screw 47 and the seal member 50 can be further suppressed.

Also as described above, the first end portions 62*a* are placed on the upper side of the upper end portion of the seal member 50 while the first protrusions 62 are in contact with at least the outermost circumferential surface of the screw blade 47*b* (at least swinging upward). By virtue of this, in reciprocative movement of the first protrusions 62 in the radial direction of the rotating shaft 47*a*, toner jumped upward by the first protrusions 62 can be prevented from reaching the contact portion between the seal member 50 and the collecting roller 43. Accordingly, backflow of the toner from the waste toner containing part 40*b* toward the opening 40*a* side can be suppressed even when the contact portion between the seal member 50 and the collecting roller 43 is clogged with paper dust or the like with a gap formed therein.

Also as described above, the second end portions 63*a* are placed on the lower side of the rotational center O of the discharge screw 47. By virtue of this, toner between the discharge screw 47 and the seal member 50 can be scraped together efficiently toward the discharge screw 47 side. Thus, deposition of the toner between the discharge screw 47 and the seal member 50 can be further suppressed.

Also as described above, the second end portions 63*a* are placed so as to be in contact with the bottom face of the waste toner containing part 40*b*. By virtue of this, toner between the discharge screw 47 and the seal member 50 can be scraped together efficiently toward the discharge screw 47 side.

Also as described above, the film member 60 includes the base portion 61 placed so as to extend in the axial direction of the rotating shaft 47*a*, the plurality of first protrusions 62 and the plurality of second protrusions 63 both protruded from the base portion 61 toward directions crossing with the axial direction of the rotating shaft 47*a*. By virtue of this, along with rotation of the discharge screw 47, the first protrusions 62 and the second protrusions 63 can be reciprocatively moved easily in the radial direction of the rotating shaft 47*a*.

Also as described above, the first protrusions 62 are protruded from the lower-end edge portion of the base portion 61, the second protrusions 63 are protruded from the upper-end edge portion of the base portion 61, and the film member 60 is formed of a one-sheet member. By virtue of this, increases in parts count can be suppressed and moreover assembling work for the belt cleaning unit 19 can be simplified.

The embodiment disclosed herein should be construed as not being limitative but being an exemplification at all points. The scope of the disclosure is defined not by the above description of the embodiment but by the appended claims, including all changes and modifications equivalent in sense and range to the claims.

For example, this disclosure has been given as an example in which the disclosure is applied to a color printer. However, without being limited to this, the disclosure, needless to say, may be applied to various image forming apparatuses equipped with the cleaning device including the cleaning member and the discharge screw, such as monochromatic printers, color copiers, monochromatic copiers, facsimiles and the like.

The foregoing embodiment has been given as an example in which the cleaning member is composed of the fur brush 41 and the collecting roller 43. However, the disclosure may be applied equivalently to structures in which only a cleaning roller is used as the cleaning member while a cleaning blade is provided for scraping off toner from the surface of the cleaning roller.

Also, the foregoing embodiment has been described on an example in which the disclosure is applied to the belt cleaning unit 19 for removing residual toner on the surface of the intermediate transfer belt 8. However, the disclosure of course can be applied similarly also to the cleaning units 5*a* to 5*d* for removing residual toner on the surfaces of the photosensitive drums (image carriers) 1*a* to 1*d*.

Also, the foregoing embodiment has been given as an example in which the first film member (first protrusions 62, base portion 61) and the second film member (second protrusions 63, base portion 61) are integrally formed by the one-sheet film member 60. However, the first film member and the second film member may be formed by individually separate members.

What is claimed is:

1. A cleaning device comprising:

a housing in which an opening facing an image carrier, and a waste toner containing part for storing toner scraped off from a surface of the image carrier, are formed;

a roller-like cleaning member placed in proximity to the opening of the housing and serving for removing residual toner on the surface of the image carrier;

a cleaning blade for scraping off waste toner on a surface of the cleaning member;

a sheet-like seal member placed in contact with the cleaning member so as to extend in a longitudinal direction of the cleaning member and serving for suppressing backflow of waste toner from the waste toner containing part toward the opening side;

a discharge screw placed in the waste toner containing part and having a rotating shaft and a screw blade to convey waste toner in an axial direction of the rotating shaft and discharge the waste toner to outside of the waste toner containing part; and a first film member and a second film member which are insertable between portions of the screw blade and which are, along with rotation of the discharge screw, reciprocatively moved in a radial direction of the rotating shaft between an outermost circumferential surface of the screw blade and an outer circumferential surface of the rotating shaft, wherein the first film member is so positioned as to be inclined constantly downward as it becomes farther and farther from the seal member, a first end portion of the first film member on one side closer to the seal member is placed on one side of a rotational center of the discharge screw closer to the seal member and is reciprocatively moved in the radial direction of the rotating shaft, the second film member is so positioned as to be inclined constantly upward as it becomes farther and farther from the seal member, and a second end portion of the second film member on one side closer to the seal member is placed between the discharge screw and the seal member and is reciprocatively moved in the radial direction of the rotating shaft.

2. The cleaning device according to claim 1, wherein the first film member is placed on an upper side of the rotating shaft.

3. The cleaning device according to claim 2, wherein the first end portion is placed on an upper side of an upper end portion of the seal member while the first film member is in contact with at least the outermost circumferential surface of the screw blade.

4. The cleaning device according to claim 1, wherein the second end portion is placed on a lower side of the rotational center of the discharge screw.

5. The cleaning device according to claim 4, wherein the second end portion is placed so as to be in contact with a bottom face of the waste toner containing part.

6. The cleaning device according to claim 1, wherein the first film member includes a first base portion placed so as to extend in the axial direction of the rotating shaft, and a plurality of first protrusions protruded from the first base portion in directions crossing with the axial direction of the rotating shaft, and the second film member includes a second base portion placed so as to extend in the axial direction of the rotating shaft, and a plurality of second protrusions protruded from the second base portion in directions crossing with the axial direction of the rotating shaft.

7. The cleaning device according to claim 6, wherein the first film member and the second film member are integrally formed by a one-sheet film member, the first base portion and the second base portion are formed with one base portion in common to each other, the first protrusions are protruded from a lower-end edge portion of the base portion, and the second protrusions are protruded from an upper-end edge portion of the base portion.

8. An image forming apparatus including the cleaning device according to claim 1.

* * * * *